US006672092B2

(12) United States Patent
Ruiz et al.

(10) Patent No.: US 6,672,092 B2
(45) Date of Patent: Jan. 6, 2004

(54) COUNTERTOP MERCHANDISER UNIT WITH REFRIGERATED AND HEATED COMPARTMENTS AND METHOD THEREOF

(75) Inventors: Guillermo A. Ruiz, Miami, FL (US); Abelardo Arafet, Hialeah, FL (US); Mark E. Allegra, Weston, FL (US); Dennis R. Headberg, Boca Raton, FL (US)

(73) Assignee: Stainless, Inc., Deerfield Beach, FL (US)

( * ) Notice: Subject to any disclaimer, the term of this patent is extended or adjusted under 35 U.S.C. 154(b) by 0 days.

(21) Appl. No.: 10/266,841

(22) Filed: Oct. 8, 2002

(65) Prior Publication Data

US 2003/0154733 A1 Aug. 21, 2003

Related U.S. Application Data

(60) Provisional application No. 60/363,658, filed on Mar. 12, 2002, and provisional application No. 60/358,158, filed on Feb. 20, 2002.

(51) Int. Cl.[7] ..... A47F 3/04

(52) U.S. Cl. ..... 62/246; 62/258

(58) Field of Search ..... 62/246, 252, 257, 62/258, 524, 526; 165/48.1, 58, 918, 919

(56) References Cited

U.S. PATENT DOCUMENTS

| | | | | | |
|---|---|---|---|---|---|
| 201,756 | A | | 3/1878 | Dealy | |
| 1,984,138 | A | | 12/1934 | Kennedy | 312/118 |
| 2,493,488 | A | * | 1/1950 | Jordan et al. | 62/116 |
| 2,631,912 | A | | 3/1953 | Pryor, Jr. | 312/138 |
| D201,756 | S | | 7/1965 | Abbott | D40/1 |
| D209,722 | S | | 12/1967 | Mangini | D80/11 |
| 4,027,727 | A | | 6/1977 | Pullens | 165/48 |
| 4,250,955 | A | * | 2/1981 | Plattner et al. | 165/244 |
| D276,578 | S | | 12/1984 | Kwiecinski | D14/114 |
| 4,704,870 | A | | 11/1987 | Beitner | 62/3 |
| 4,823,554 | A | * | 4/1989 | Trachtenberg et al. | 62/3.3 |
| 4,884,626 | A | | 12/1989 | Filipowski | 165/12 |
| D312,363 | S | | 11/1990 | Faggioli | D6/471 |
| D321,800 | S | | 11/1991 | Blum | D6/472 |
| 5,069,273 | A | * | 12/1991 | O'Hearne | 165/206 |
| 5,247,807 | A | | 9/1993 | Jarman et al. | 62/227 |
| D352,620 | S | | 11/1994 | Geisen et al. | D6/470 |
| 5,626,028 | A | * | 5/1997 | Graat et al. | 62/252 |
| 5,743,098 | A | | 4/1998 | Behr | 62/80 |
| 5,893,620 | A | * | 4/1999 | Birgelis | 312/408 |
| 6,073,547 | A | * | 6/2000 | Westbrooks, Jr. et al. | 99/468 |
| 6,257,010 | B1 | | 7/2001 | Shei et al. | 62/252 |

FOREIGN PATENT DOCUMENTS

| | | | | | |
|---|---|---|---|---|---|
| DE | 19841696 | A1 | | 9/1998 | |
| DE | 019841696 | A1 | * | 3/2000 | A47F/10/06 |
| DE | 0 990 405 | A2 | | 4/2000 | |
| EP | 161178 | A | * | 11/1985 | A47J/36/24 |
| EP | 0990405 | A2 | * | 4/2000 | A47J/39/00 |
| FR | 0 161 178 | | | 11/1985 | |
| JP | 8-24145 | | | 1/1996 | |
| JP | 408024145 | A | * | 1/1996 | A47J/39/00 |

* cited by examiner

*Primary Examiner*—William E. Tapolcai
*Assistant Examiner*—Mohammad M. Ali
(74) *Attorney, Agent, or Firm*—Robert C. Kain, Jr.; Fleit Kain

(57) ABSTRACT

A countertop merchandiser unit facilitates impulse purchasing of heated and chilled items by providing for placement and display of the items in close proximity with a cash register. The countertop unit has an enclosed transparent refrigerated compartment located above a countertop, an enclosed transparent heated compartment located above the refrigerated compartment and a refrigeration unit located above the heated compartment. Access doors at the rear of the countertop unit allow a vendor or cashier to access items stored therein. Access doors at the front of the countertop unit allow a customer to access items stored therein, the front access doors may be selectively fastened closed to deter shoplifting of items stored therein.

5 Claims, 9 Drawing Sheets

COUNTERTOP MERCHANDISER UNIT WITH REFRIGERATED AND HEATED COMPARTMENTS AND METHOD THEREOF

CROSS REFERENCE TO RELATED APPLICATIONS

This non-provisional patent application claims priority to provisional patent application Ser. No. 60/363,658 [pending] to Guillermo A. Ruiz et al., for "Countertop Unit With Warm and Cold Containment and Method Thereof" filed Mar. 12, 2002, and also claims priority to provisional patent application Ser. No. 60/358,158 [pending] to Guillermo A. Ruiz et al., for "Countertop Unit With Warm and Cold Containment and Method Thereof" filed Feb. 20, 2002. Said provisional applications are incorporated by reference in their entirety.

BACKGROUND OF THE INVENTION

Impulse purchasing is a familiar marketing phenomenon that can substantially increase sales of certain items. Typically, a consumer shopping in a retail outlet will find a number of items merchandised near a cash register. The items are displayed in such a way as to facilitate impulse purchasing. Attractively packaged items on display and readily available at the approximate time and place of a purchase of other already selected items facilitates the impulse purchase of those additional items. Such additional items typically include magazines, tabloids, candies and various articles of popular culture. Many such items may be dispensed from a dispenser located upon a countertop close to the cash register. The countertop dispenser has the advantage of allowing the retailer to easily adjust the location of the dispenser within a relatively scarce area around a cash register in response to the various needs of the particular retailer. Unfortunately, countertop dispensers are typically limited to the type of product that can be displayed and made available for impulse purchasing. Such dispensers typically dispense items that can only be stored and marketed at ambient room temperatures.

There are a number of items that could potentially be suitable for impulse purchasing but require either refrigeration or heating. Such items include cold drinks such as a bottled tea and warm foods such as a slice of apple pie. Impulse purchasing would be facilitated if a consumer could view such items in a condition ready for purchase at the time and location of a purchase of other already selected items. Such impulse shopping is further facilitated if the retailer is in the business of selling prepared food. For example, a fast food retailer would likely sell more warm deserts and cool drinks if such items were attractively packaged and displayed close to the cash register. The sight of these items close to a cash register would likely cause their purchase in addition to items already selected by the consumer. This would consequently increase the retailer's sales and profitability with respect to those items. However, a problem arises in that current merchandisers are limited to dispensing ambient temperature items and that current refrigerators or ovens are large floor mounted items that are difficult to place close to a cash register without substantial modifications to existing fixtures. Furthermore, retailers prefer not to modify existing countertops or other existing fixtures to facilitate the display of heated and chilled items.

Impulse purchasing is facilitated by a purchaser being able to remove items from a display prior to purchase and then purchase the items. However, the ability to remove items without the aid of a cashier or vendor also facilitates shoplifting of those items. Shoplifting may be difficult to deter in a fast food retail environment where food is consumed on sight and cashiers are often not present to monitor heated or chilled items removed from a corresponding dispensing display. However, shoplifting may vary on a location-by-location basis. One retail outlet may have little or no issue with shoplifting and a different retail outlet in a different location may have a substantial issue with shoplifting. Thus, the problem arises regarding how to facilitate impulse buying of heated and chilled items with a common dispensing unit while deterring shoplifting on a location-by-location basis.

Thus, what is needed is a unit having both refrigerated and heated compartments. The unit should be compact and able to be placed on top of a countertop and preferably close to a cash register. The unit should require no substantial modification to the countertop or other fixture. What is further needed is a countertop unit that selectively provides customer access to facilitate impulse purchasing and a first retail location yet deter shoplifting at another retail location.

DETAILED DESCRIPTION OF THE INVENTION

It is important to note that these embodiments are only examples of the many advantageous uses of the innovative teachings herein. In general, statements made in the specification of the present application do not necessarily limit any of equivalent of the various claimed inventions. Moreover, some statements may apply to some inventive features but not to others. In general, unless otherwise indicated, singular elements may be in the plural and visa versa with no loss of generality.

The countertop merchandiser unit has an accessibly enclosed heated compartment located above an accessibly enclosed refrigerated compartment. The vertical surfaces are substantially transparent to facilitate viewing of the contents of the refrigerated and heated compartments. The refrigerated and heated compartments have independent rear access doors providing access preferably to a vendor or cashier. The refrigerated and heated compartments have a clear fixed front panel for displaying contents therein or, as an alternative, independent front access doors providing access preferably to a customer. The front access doors may be fastened shut, thereby deterring potential shoplifting when fastened. The heated compartment has an internal heater that is preferably electrical. Above the heated compartment is a refrigeration unit for providing cooling via at least one evaporator located within the refrigerated compartment. An insulated wall separates the heated and refrigerated compartments. The base of the refrigerated compartment has a bottom exterior surface adapted so that the countertop unit may be placed upon a countertop preferably close to a cash register.

Figure 1:
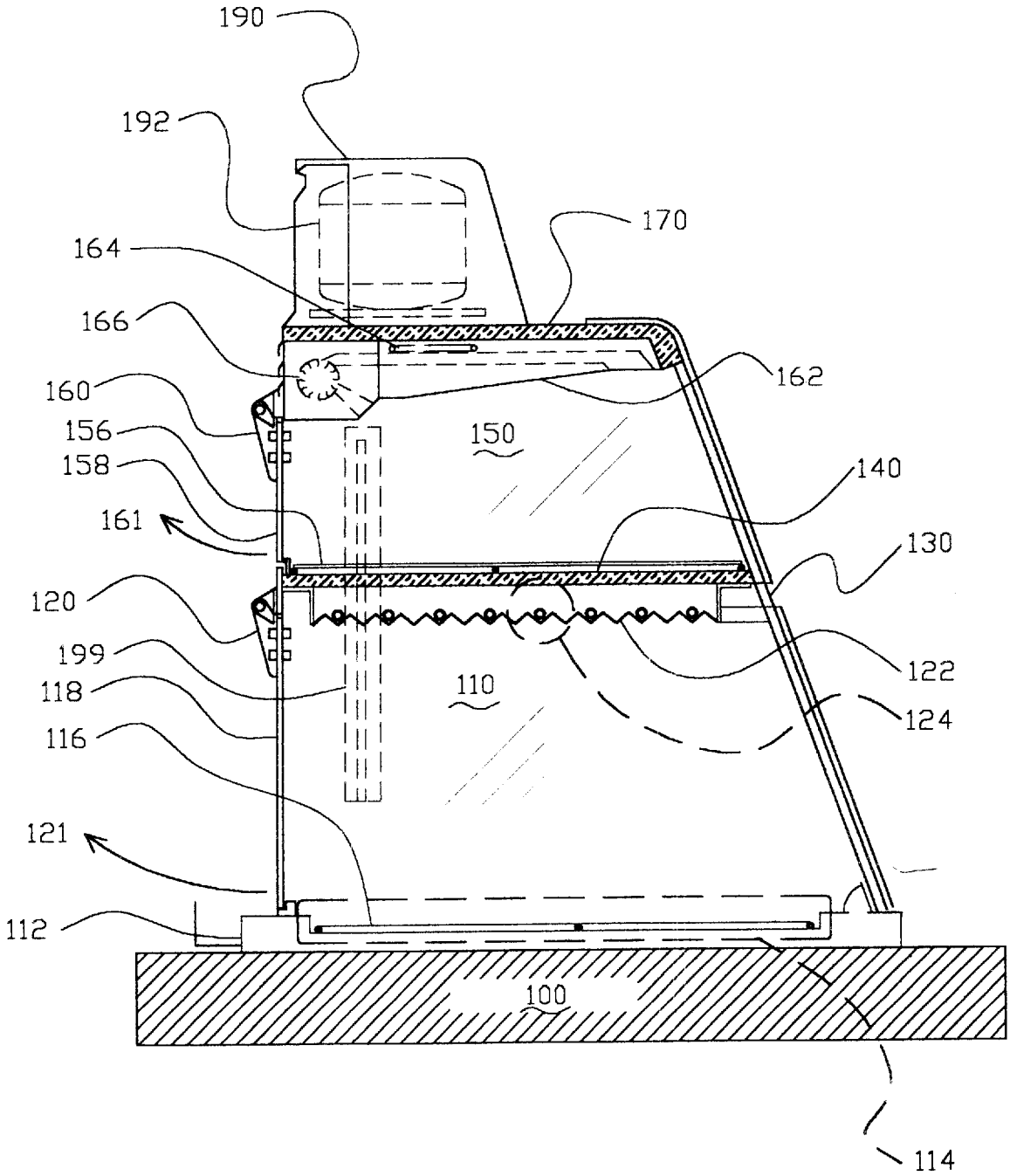
FIG. 1 shows a side cross sectional plan view of a first embodiment of a countertop unit constructed in accordance with the present invention.

FIG. 1 shows a side cross sectional plan view of a first embodiment of a countertop merchandiser unit constructed in accordance with the present invention. The countertop unit is shown resting on top of a countertop 100. A refrigerated compartment 110 is located above the countertop 100, a heated compartment 150 is located above the refrigerated compartment 110, and a refrigeration unit 190 is located above the heated compartment 150. The refrigerated compartment has a horizontal base 112 located at its bottom. The bottom exterior surface of the base 112 is substantially flat to facilitate resting the countertop unit on top of the countertop 110. No modification to countertop 100 is necessary. The weight of the countertop unit and a friction coupling between the base and the countertop inhibits movement of the countertop unit relative to the countertop. Alternatively rubber feet may be affixed to the base 112, the countertop unit may be fastened with fasteners to the countertop, or other countertop mountings known to those familiar with the art may be utilized. The base further has a shallow recess region 114 for accepting a wire rack 116. Items within the refrigerated compartment 110, such as bottles of ice tea, preferably rest upon the wire rack 116 and are spaced apart from base 112. At the rear of the countertop unit is a rear refrigerated compartment access door 118 attached to the countertop unit via a hinge 120. The rear refrigerated compartment access door 118 is preferably clear thereby facilitating viewing of the contents therein. This transparency assists in inventory control. Hinge 120 allows the refrigerated compartment access door 118 to swing in an outwardly and upwardly direction 121. When open, door 118 provides access to the refrigerated compartment. When closed, door 118 encloses and insulates the refrigerated compartment from the ambient environment exterior to the countertop unit.

Along the top wall of the refrigerated compartment 110 is a primary evaporator 122 having alternating V-shaped channels facilitating heat absorption from the refrigerated compartment. Within the evaporator 112 are serpentine coils 124 which circulate coolant from refrigeration unit 190. Coils are disposed in alternating V-shaped grooves in the evaporator.

A fixed front panel 130 forms a front wall for both the refrigerated and heated compartments. The front access panel 130 is preferably clear providing viewing of contents stored in both the refrigerated and heated compartments. Side panels of the refrigerated compartment (not shown; see FIG. 2) form side walls of the countertop unit that are also preferably clear thereby facilitating viewing of contents refrigerated therein.

An insulating wall 140 is located between the refrigerated and heated compartments. The primary evaporator 122 at the top of the refrigerated compartment 110 is coupled or mounted to the insulating wall 140. Cool air flow from evaporator 122 is established by gravity and air convection flow in the refrigerated compartment. Refrigerated compartment 110 is enclosed by base 100 on the bottom, evaporator 122 and insulating wall 140 on the top, side walls (not shown), front panel 130 and by the rear refrigerated access door 118 when closed. The front, back and side walls of the refrigerated compartment are preferably clear and provide insulation for the enclosed refrigerated compartment.

The insulating wall 140 (at the top of refrigerated compartment 110) also forms the bottom of the heated compartment 150. The bottom of the heated compartment accepts a wire rack 156. Rack 156 spaces items apart from the bottom. Items within the heated compartment 150, such as warm apple pie, preferably rest upon the wire rack 156. At the rear of the countertop unit is a rear heated compartment access door 158 attached to the countertop unit via a hinge 160. The rear heated compartment access door 158 is preferably clear thereby facilitating viewing of the contents therein and enabling inventory control. Hinge 160 allows the heated compartment access door 158 to swing in an outwardly and upwardly direction 161. Alternatively, compartments 150, 110 could have downwardly swinging doors or slide doors (horizontally configured). When open, door 158 provides access to the heated compartment. When closed, door 158 encloses and insulates the heated compartment from the ambient environment exterior to the countertop unit.

Along the top wall of the heated compartment 110 is an internal heater having a plenum 162, an electrically heated heater element 164 for converting electrical energy to heat energy and a fan 166 for circulating heated air within the heated compartment.

The fixed front panel 130 forms a front wall for both the refrigerated and heated compartments. The front panel 130 is preferably clear providing viewing of contents stored in both the refrigerated and heated compartments. Side panels of the heated compartment (not shown) form the side walls of the countertop unit and are also preferably clear thereby facilitating viewing of contents heated therein. The internal heater at the top of the heated compartment 150 is coupled to a heater module housing wall 170 located at the top of the heated compartment. Heater compartment 150 is enclosed by insulating wall 140 on the bottom, internal heater and heater module housing wall 170 on the top, side walls (not shown), front panel 130 and by the rear heated compartment access door 158 when closed. The front, back and side walls of the heated compartment are preferably clear and provide insulation for the enclosed refrigerated compartment. Vertically disposed lamp 195 illuminates both refrigerated and heated compartments, further facilitating viewing contents stored therein. The refrigerated compartment access door and the heated compartment access door are preferably independent and open and close independently.

Refrigeration unit 190 rests on top of the heater module housing wall 170 of heated compartment 150. The refrigeration unit includes a compressor 192 and condenser and cooling fan (not shown). Through a process well known to those familiar with the art, coolant fluid compressed by the compressor and cooled in the condenser by the cooling fan refrigerates the refrigerated compartment 110 when evaporated in evaporator 122. The refrigeration unit 190 transfers heat from the refrigerated compartment to an ambient environment external to the countertop unit located above the heated compartment.

Figure 2:
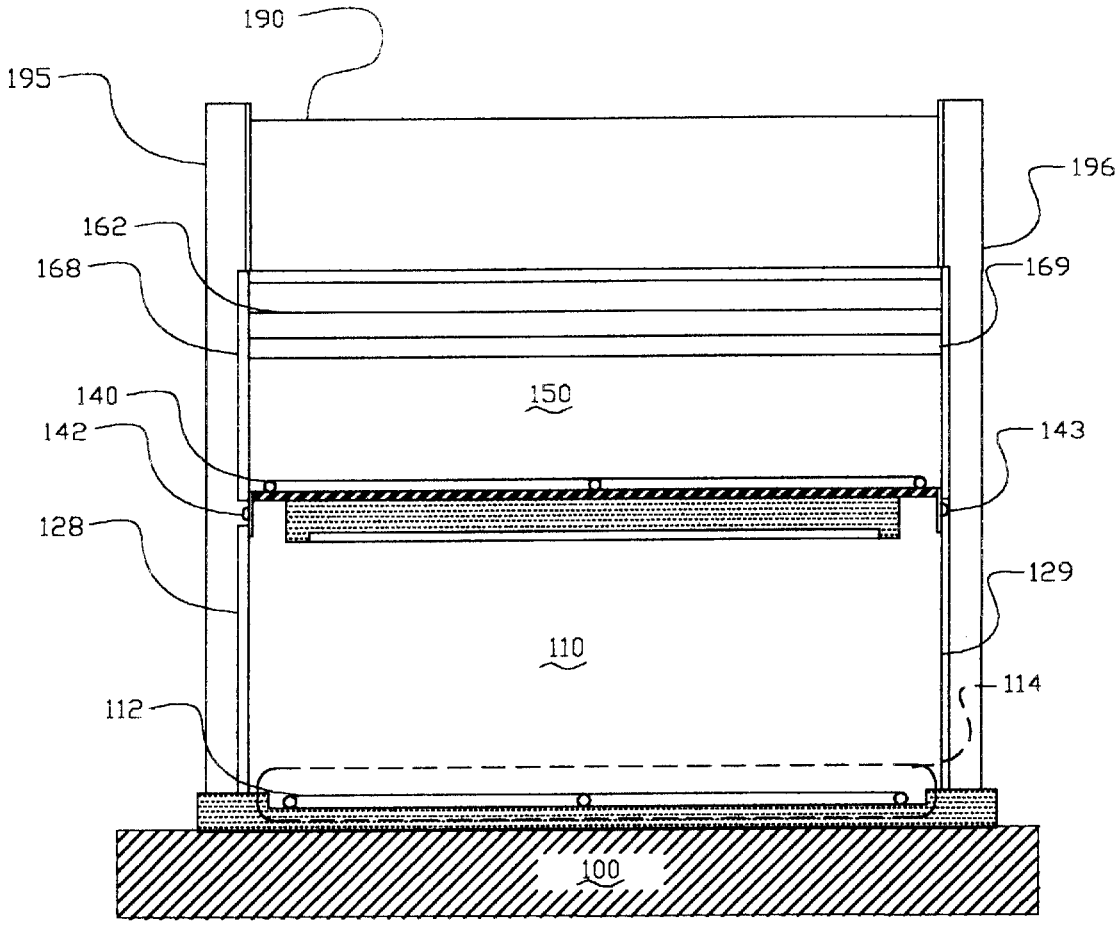
FIG. 2 shows a front cross sectional plan view of the first embodiment of the countertop unit constructed in accordance with the present invention.

FIG. 2 shows a front cross sectional plan view of the first embodiment of the countertop unit constructed in accordance with the present invention. Items in FIG. 2 that are identical to items in FIG. 1 are identically numbered. FIG. 2 also shows refrigerated compartment side panels 128 and 129, heated compartment side panels 168 and 169, and side tracks 142 and 143 that comprise the side walls of the countertop unit. Side tracks 142 and 143 are located between the refrigerated and heated compartments. Side columns covered by column covers 195 and 196 engage the base 112 at the bottom the refrigeration unit at the top. Columns and column covers 195 and 196, rails 142 and 153, refrigerated compartment side panels 128 and 129 and heated compartment panels 168 and 169 form a side wall structure that at least partially provides structural support for the refrigeration unit the heated and refrigerated compartments.

Figure 3:
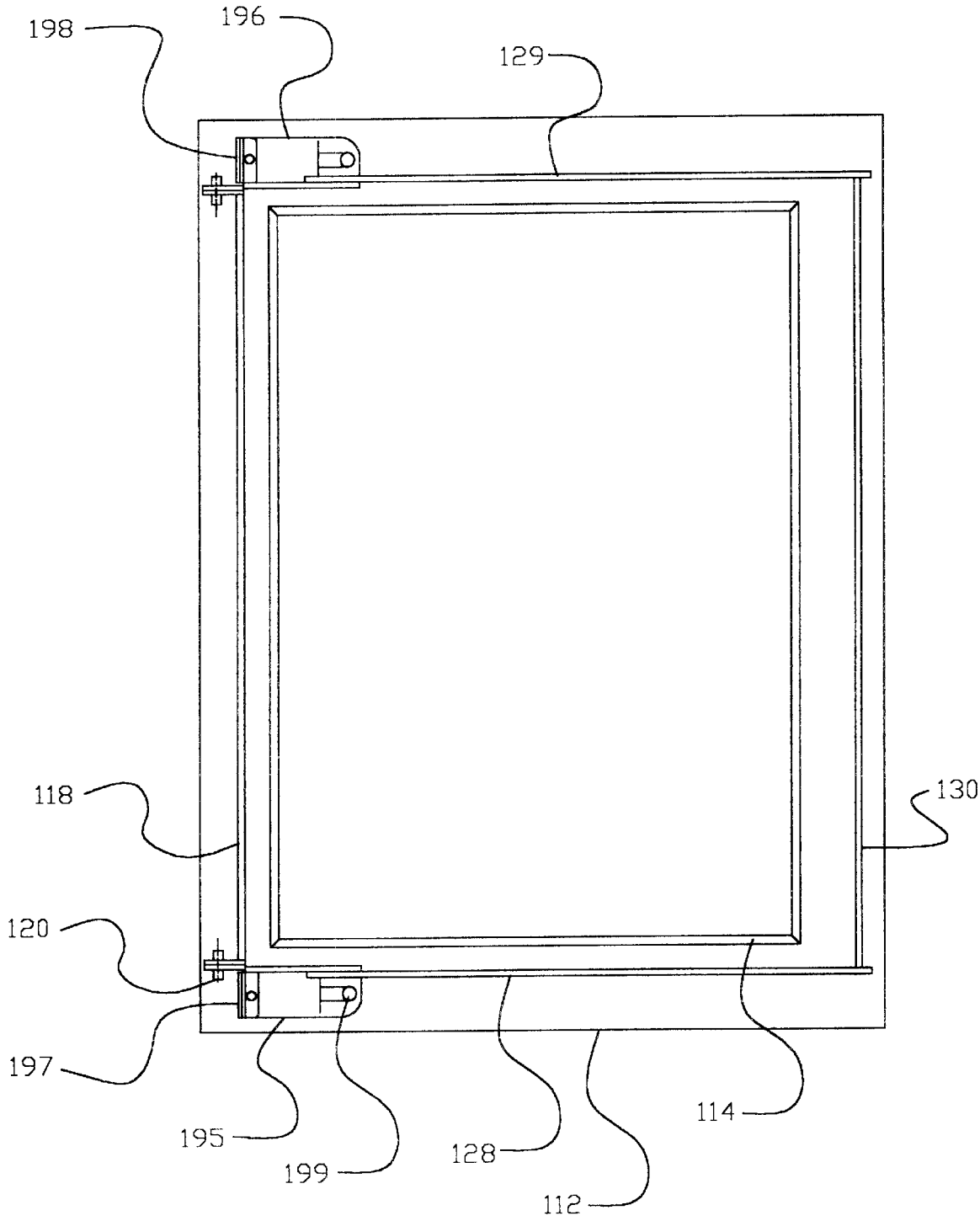
FIG. 3 shows a top down cross sectional plan view of the refrigerated compartment of the first embodiment of the countertop unit constructed in accordance with the present invention.

FIG. 3 shows a top down cross sectional plan view of the refrigerated compartment of the first embodiment of the countertop unit constructed in accordance with the present invention. Items in FIG. 3 that are identical to items in FIG. 1 and FIG. 2 are identically numbered. FIG. 3 shows the area of the cross-hatched shallow recess 114 and further shows the detail of the side columns 197 and 198. Side columns are preferably metallic and facilitate the transfer of a substantial portion of the weight of the refrigeration unit to the base without substantially obstructing the visibility into the refrigerated and heated compartments.

The location of refrigeration unit above the heated compartment has the advantage of locating the refrigeration unit well above the countertop in a substantially unenclosed area, thereby avoiding heat retention within a confined space of the retail establishment. This substantially unobstructed heat exchange improves the efficiency and reliability of the countertop unit. The refrigeration unit location has the further advantage of providing for the transfer of heat from the refrigerated compartment to the ambient environment without exposing the customer or vendor to excessive heat. The refrigeration unit is high enough to disburse heat above its retail operators. This provides a more palatable presentation environment thereby facilitating impulse purchasing.

The extensive use of transparent walls in the front , on the sides and in the rear enhance sales of merchandise in the merchandiser unit.

The countertop is preferably thirty six inches above a floor surface, but may vary between twenty four and forty eight inches above the floor surface. The top of the heated compartment is preferably twenty four inches above the countertop but may vary between eighteen and thirty six inches above the countertop. These dimensions have the advantage of providing easy countertop access to the refrigerated and heated compartments by both customers and vendors or cashiers. For customer access, the front walls must have hot and cold compartment access doors. Furthermore this locating the refrigeration unit above the heated compartment facilitates communication between a customer and a vendor or cashier while providing efficient refrigeration and heat exchange with the ambient environment above the countertop unit.

The weight of the refrigeration unit 190 is supported at least partially by the walls of the heated compartment 150. The weight of the heated compartment 150 plus the refrigeration unit 160 is supported at least partially by the walls of the refrigerated compartment which is then transferred to the base 112. The bottom base 112 facilitates transfer of the weight of the countertop unit to the countertop 100. This structure provides for the convenient placement of the unit on a countertop without modification to the countertop. Furthermore, the countertop unit may be easily relocated to facilitate impulse purchasing and other vendor operations.

Enclosing the refrigerated compartment has the advantage of providing for a compact refrigerated compartment, while its transparent walls provide for viewing of items therein. Furthermore, the heated compartment abuts the refrigerated compartment. The heated and refrigerated compartments are separated by common wall including the insulated wall 140. The substantially thin common wall and the compact enclosed refrigerated compartment have the advantage of closely spacing the heated and refrigerated compartments. This has the advantage of reducing the overall size and height of a unit having warm and cold compartments. Convection air flow from the evaporator, enabling hot air to rise and cool air to fall, in cold compartment 110 also provides a compact, efficient merchandiser.

Figure 4:
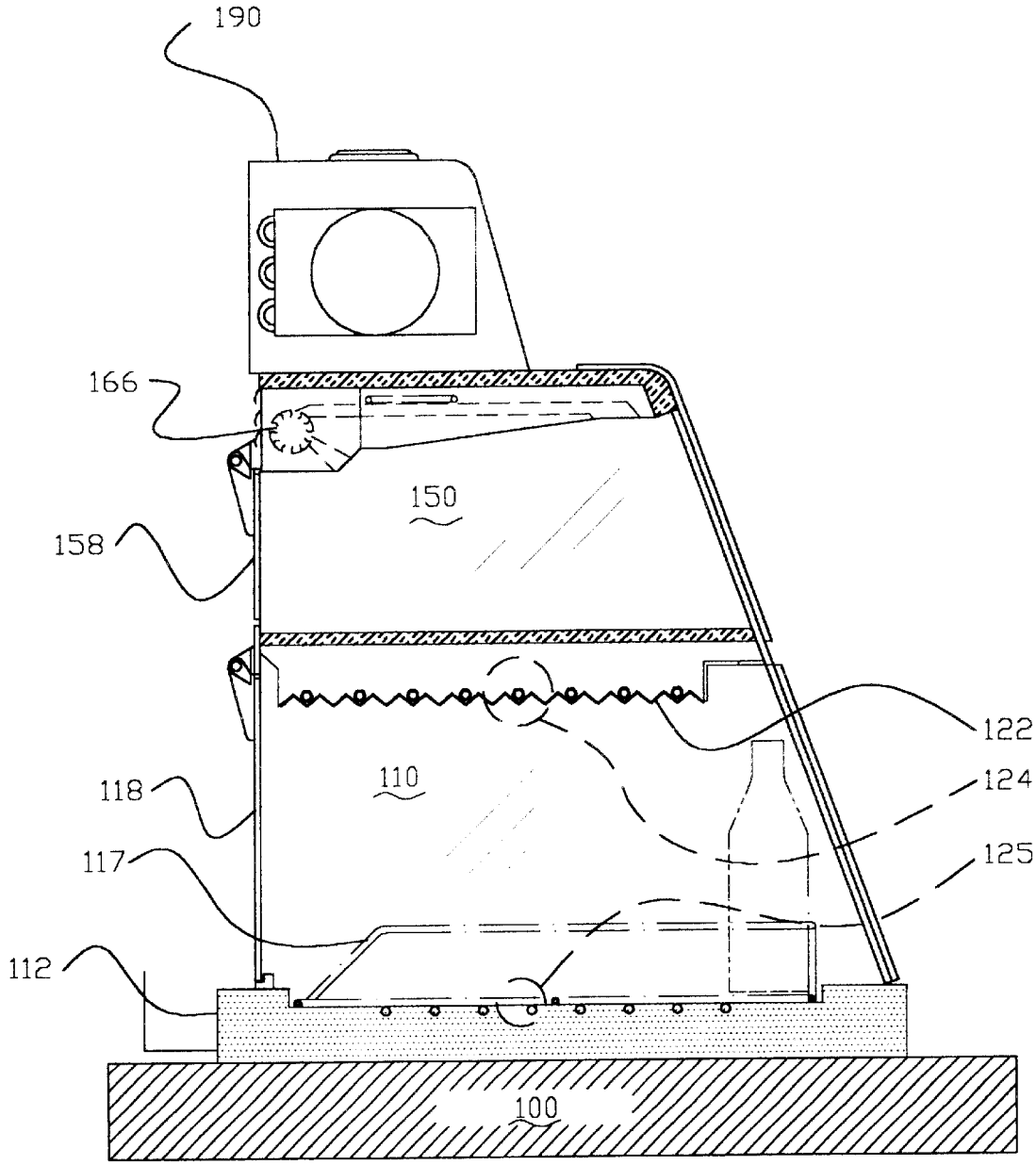
FIG. 4 shows a side cross sectional plan view of a second embodiment of a countertop unit constructed in accordance with the present invention.

FIG. 4 shows a side cross sectional plan view of a second embodiment of a countertop unit constructed in accordance with the present invention. Items in FIG. 4 that are identical to items in FIG. 1 are identically numbered. FIG. 4 shows that a single layer of coolant coils 125 are incorporated within the base 112 at the bottom of the refrigerated compartment 110. Thus, the refrigerated compartment 110 has dual evaporators, one on the top 122 and one on the bottom of the enclosure. Dual evaporators enhance convection air flow. The base 112 acts as a second complementary evaporator on the bottom of the refrigerated compartment. The primary evaporator is at the top of the compartment 110. Also shown is an alternate version of the wire rack 117. The wire rack has the advantage of separating items stored in the refrigerated compartment from the evaporator at the base of the refrigerated compartment. This separation inhibits undesirable freezing of items stored in the refrigerated compartment by avoiding direct contact between the items and the evaporator. The separation enhances cooling of the merchandise due to air flow through the rack space and facilitates cleaning of the unit after removal of the wire rack.

Figure 5:
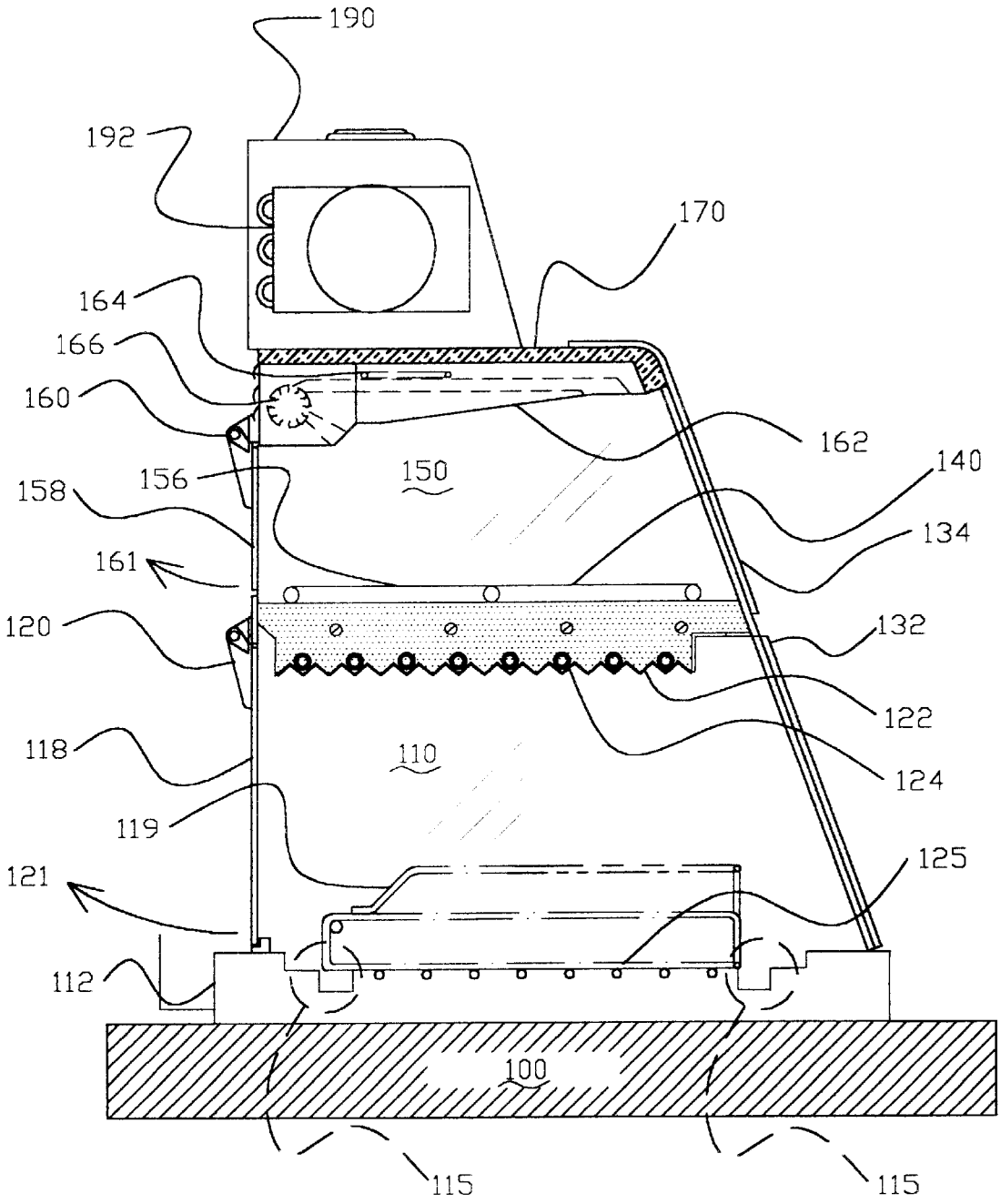
FIG. 5 shows a side cross sectional plan view of a third embodiment of a countertop unit constructed in accordance with the present invention.

FIG. 5 shows a side cross sectional plan view of a third embodiment of a countertop unit constructed in accordance with the present invention. Items in FIG. 5 that are identical to items in prior figures are identically numbered. The third embodiment shown by FIG. 5 is similar to the second embodiment shown by FIG. 4 in that the refrigerated compartment has complementary upper and lower evaporators. However the base of FIG. 5 does not have a shallow recess. Rather a peripheral channel 115 is formed around the lower evaporator and its corresponding coolant coils 125 incorporated therein. Furthermore the surface of the lower evaporator is slightly elevated relative to the outer surface of the base contacting a bottom edge of the front, back and side walls of the countertop unit. The elevation facilitates cleaning of the interior of the unit. The wire rack 119 of the refrigerated compartment is adapted to the changes to the base while spacing merchandise there above and inhibiting freezing of items stored therein. The front wall of the third embodiment also has a refrigerated compartment front panel 132 and a separate heated compartment front panel 134. The panels shown are removable. In an alternate embodiment, the front panels are hinged (not shown) similar to the hinged rear panels 118 and 158. Vendor or cashier access is preferably achieved via refrigerated and heated compartment rear access doors 118 and 158. Hinging the front panels provide refrigerated and heated compartment front access doors allowing customers to access items stored therein, thereby further facilitating impulse purchasing. Furthermore, if the countertop unit having hinged front access doors is used in an area where it is desirable to deter shoplifting, then a fastening device (not shown) would be installed on an unhinged edge of each front access door. The fastening device includes a screw, bolt, lock or other fastening device known to those familiar with the art.

Figure 6:
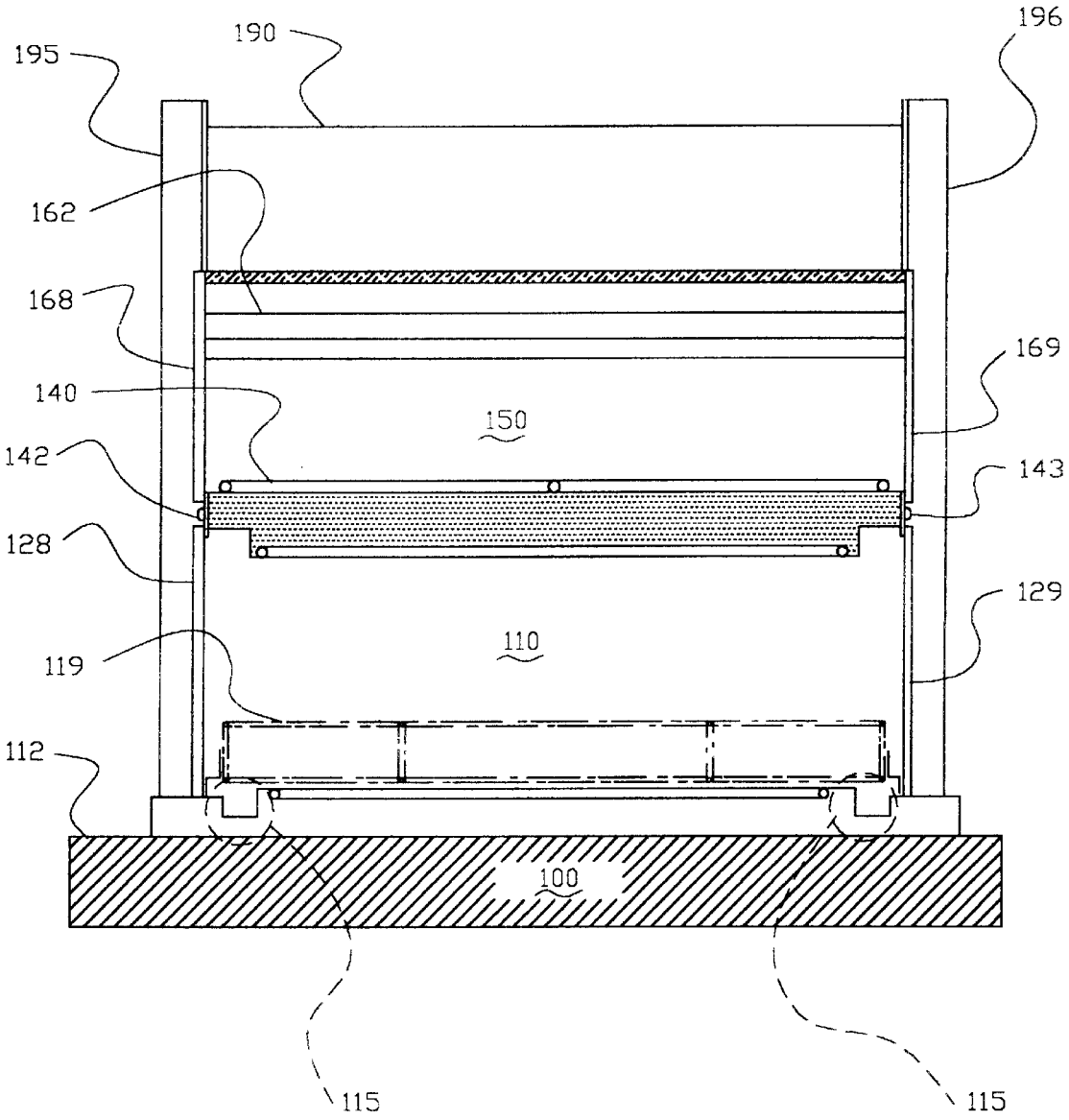
FIG. 6 shows a front cross sectional plan view of the third embodiment of the countertop unit constructed in accordance with the present invention.

FIG. 6 shows a front cross sectional plan view of the third embodiment of the countertop unit constructed in accordance with the present invention. Items in FIG. 6 that are identical to items of prior figures are identically numbered. FIG. 6 particularly shows details of the channel 115 and the raised surface of the evaporator in base 112.

Figure 7:
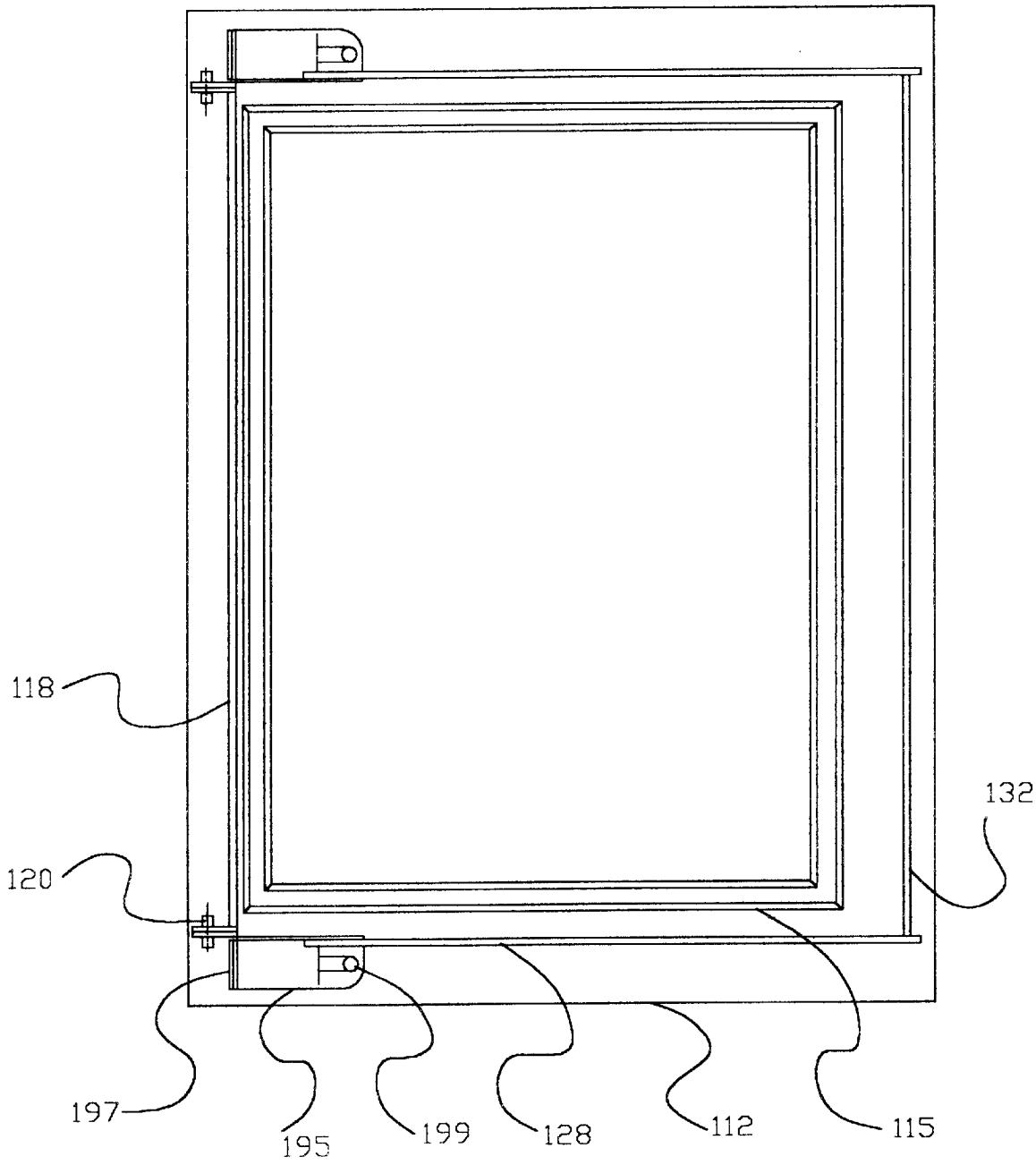
FIG. 7 shows a top down cross sectional plan view of the refrigerated compartment of the third embodiment of the countertop unit constructed in accordance with the present invention.

FIG. 7 shows a top down cross sectional plan view of the refrigerated compartment of the third embodiment of the countertop unit constructed in accordance with the present invention. Items in FIG. 7 that are identical to items in prior figures are identically numbered. FIG. 7 additionally shows the detail of the cross-hatched channel 115 in the base 112.

Figure 8:
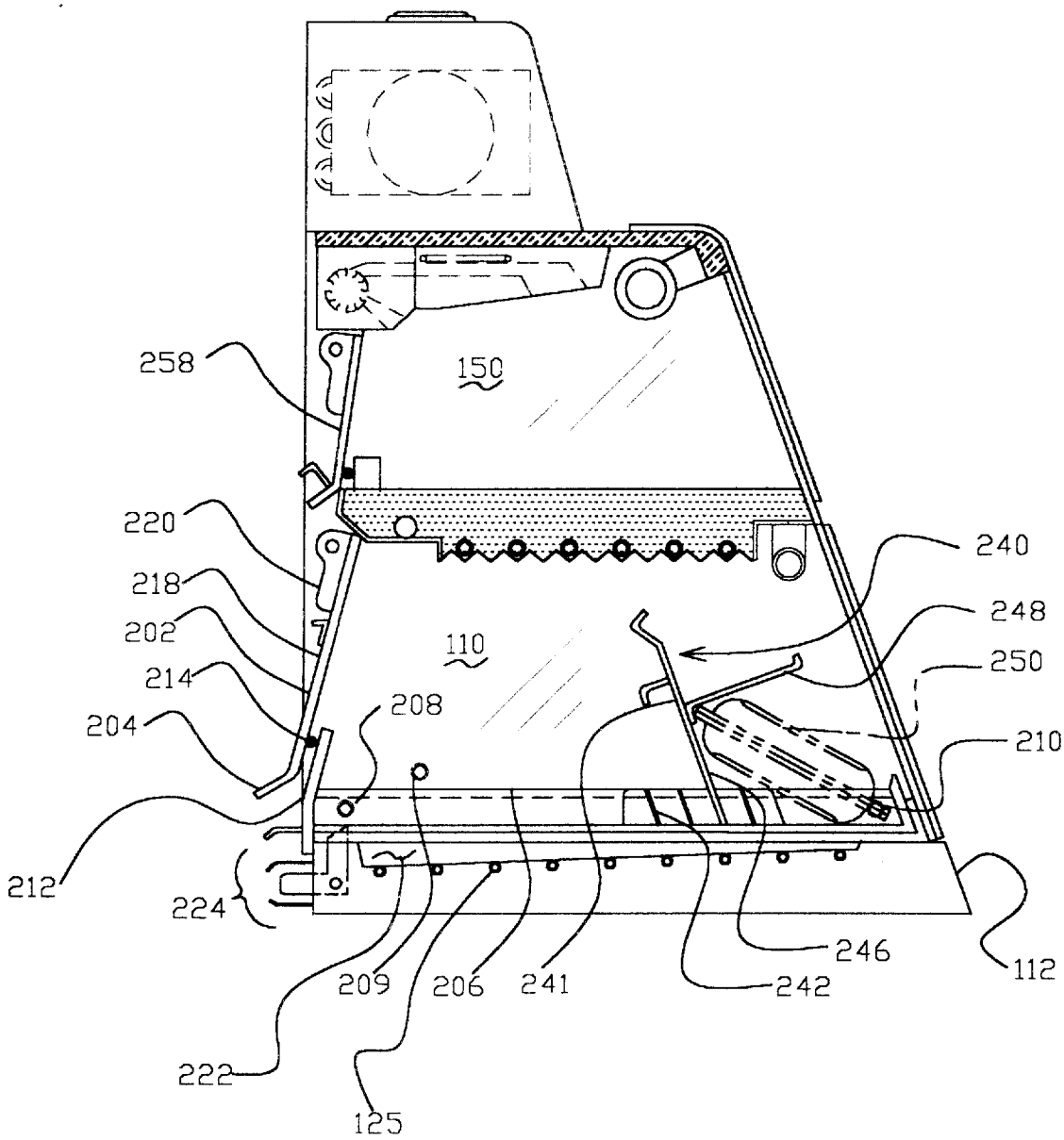
FIG. 8 schematically shows a side elevational view of the merchandiser with a slidable shelf and a forward facing display rack.
Figure 9:
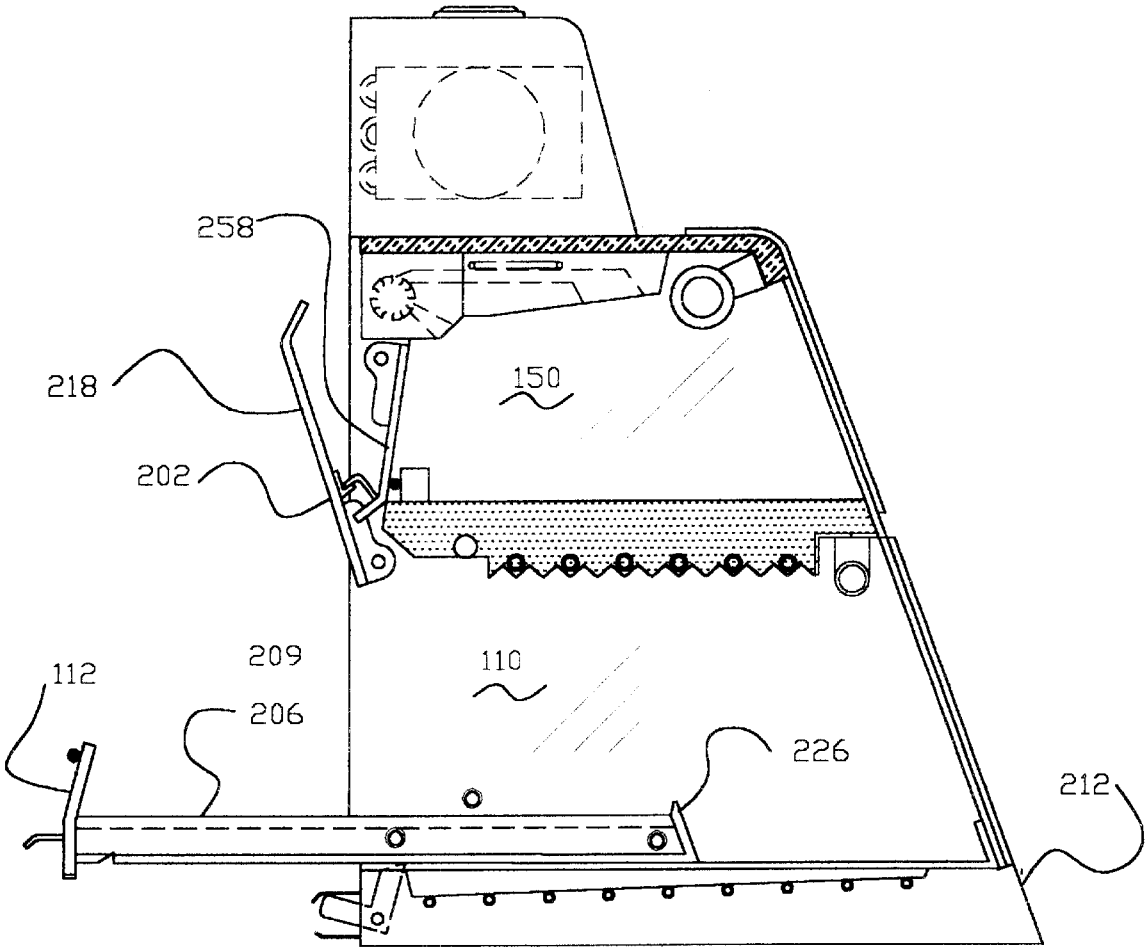
FIG. 9 schematically shows the merchandiser with the shelf partially withdrawn.

FIG. 8 schematically illustrates the merchandiser with a movable shelf 206. The shelf 206 extends beyond access door 218 as shown in FIG. 9. Both figures are discussed currently herein. Refrigerated compartment access door 218 is foreshortened compared to access door 118 in, for example, FIG. 1, in that door 218 only partially encloses the rear of compartment 110. Door 218 includes an angulated tab 204 to permit the user to open the door. Hinge 220 pivotally mounts the door 218 to the rearward portion of the refrigerated compartment 110.

Pull-out shelf 206 permits the user easy access to food products in the compartment 110. This is especially true in that the merchandiser is simply placed on top of a countertop which, by definition, is easily used by a user. Shelf 206, in the illustrated embodiment, is movably mounted by a roller system, see rollers 208, 209 and 210, in compartment 110. Other movable mounting systems may be used for shelf 206. Shelf 206 also includes a rearward closure panel 212. Panel 212 cooperates and mates with access door 218 to completely enclose the rear of compartment 110. Rubber or plastic seal 214 on one or the other of the access door 218 or the closure panel 212 seals the refrigeration compartment 110. The partial access door 218 enables the user the quickly open and gain access to refrigerated compartment 110. Panel 212 limits the release of cool air from compartment 110 since it partially encloses compartment 110. If the user wants access to items deep within compartment 110, he or she opens door 218 (see FIG. 9), pulls out the shelf 206 (with the assistance of roller system 208, 209 and 210), and removes items stored deep within the compartment 110. Roller 209 also acts as a stop in conjunction with stop limit lip 226 on shelf 206 in FIG. 9. Removal of the shelf and full outboard movement of shelf 206 is also limited by latch system 224. Latch system 224 includes upper and lower guards and a pivoting bar having an inboard end cooperating with a limit stop (not shown) on the lower, forward end of the shelf 206. To completely remove shelf 206 from the compartment 110, the user raises the pivot latch bar which lowers the bar's forward end.

The merchandiser in FIG. 8 also includes a removable display shelf system 240. The rack 240 is typically mounted on movable shelf 206. Display system 240 includes a main rack element 241 generally vertically disposed at an angle in compartment 110 by insertion of the lower portion of the main rack 241 in slot 246 of mount member 242. The angle of disposition of rack element 241 is about 20 degrees with respect to the horizontal countertop. Mount member 246 has a plurality of slots 246 such that the user can place the rack body element 241 at various forward and aft positions in compartment 110. A similar display rack system, smaller than system 240, may be placed in the heated compartment. Rack system 240 includes an angularly offset horizontal rack element 248 which enables the user to place food product at an angle in compartment 110 between the angulated but generally vertical rack body element 241 and the angulated but generally horizontal rack element 248. Food product 250 is shown disposed in an angulated display manner with its lower package resting on the forward end of the movable shelf 206 and its rearward package resting on main rack element 241. The angulated display of food product enhances sales of the food displayed in the case. The rack system 240 is mounted on the movable pull-out shelf 206 such that if all similar food products, similar to display product 250, have been removed from the compartment 110, the user can easily roll out the shelf, remove product 250 from forward display rack 240 and sell the product.

Figure 10:
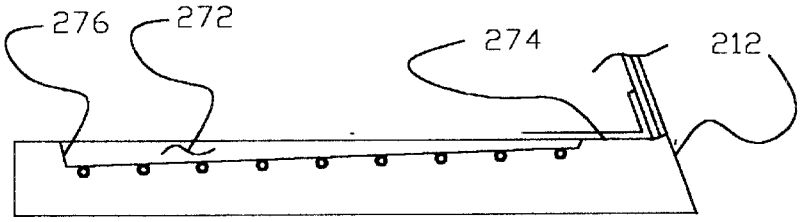
FIG. 10 shows another configuration for the base with a drain and cleaning sloped surface.

FIG. 10 shows another configuration of the base 112 forming a rearward capture recess 272. The upper surface of the base is sloped such that at forward end 274 there is little or no recess. The surface slopes or is tapered towards the rearward portion 276 of the base thereby forming a rear recess 272. Rear recess 272 may be used to catch liquid spilled from food product or may be used to capture cleaning liquid during the periodic cleaning of the merchandiser.

Thus, what is provided is a unit having both refrigerated and heated compartments. The unit is compact and able to be placed on top of a countertop and preferably close to a cash register. The unit does not require substantial modification to the countertop or other fixture. What is further provided is a countertop unit that selectively provides customer access to further facilitate impulse purchasing in one configuration and deter shoplifting in another configuration.

Although specific embodiments of the invention have been disclosed. It will be understood by those familiar with the art that changes can be made to these specific embodiments without departing from the spirit and scope of the invention. The scope of the invention is not to be restricted, therefore, to the specific embodiments, and it is intended that the appended claims cover any and all such applications, modifications, and equivalent embodiments within the scope of the present invention.

What is claimed is:

1. A countertop merchandiser unit comprising:

a refrigerated compartment adapted to be supported by a countertop, said refrigerated compartment is enclosed and includes a refrigerated compartment access door for providing access thereto when open and for enclosing said refrigerated compartment when closed;

a heated compartment supported above said refrigerated compartment, said heated compartment is enclosed and includes a heated compartment access door for providing access thereto when open and for enclosing said heated compartment when closed;

a pull-out shelf movably mounted in said refrigerated compartment and extendible beyond said refrigerated compartment access door thereby permitting loading and unloading of said refrigerated compartment;

wherein said shelf includes a rearward closure panel, said refrigerated compartment access door only partially encloses said refrigerated compartment, and said closure panel mates with said refrigerated compartment access door to fully enclose an end of said refrigerated compartment.

2. A countertop merchandiser unit as claimed in claim 1, wherein said refrigerated compartment has a front side and a rear side and further includes:

a hinge for said refrigerated compartment access door disposed at said rear side for providing rear access thereto when open;

said refrigerated compartment access door only partially enclosing said rear side of said refrigerated compartment;

said shelf includes a rearward closure panel which mates with said refrigerated compartment; access door to fully enclose an end of said refrigerated compartment.

3. A countertop merchandiser unit as claimed in claim 1, including a merchandise display rack forwardly mounted within said refrigerated compartment to permit the display of cooled food thereat.

4. A countertop merchandiser unit as claimed in claim 3, wherein said display rack is mounted at an angle relative to said countertop to permit the angular display of food thereat.

5. A countertop merchandiser unit as claimed in claim 1, including a merchandise display rack forwardly mounted on said pull-out shelf within said refrigerated compartment to permit the display of cooled food thereat.

* * * * *